United States Patent [19]

Bratkowski et al.

[11] Patent Number: 4,801,772

[45] Date of Patent: Jan. 31, 1989

[54] CURRENT LIMITING CIRCUIT INTERRUPTER WITH INSULATING WEDGE

[75] Inventors: Walter V. Bratkowski, McKeesport; James P. Ellsworth, Beaver, both of Pa.

[73] Assignee: Westinghouse Electric Corp, Pittsburgh, Pa.

[21] Appl. No.: 163,354

[22] Filed: Mar. 2, 1988

[51] Int. Cl.[4] ..... H01H 33/06

[52] U.S. Cl. ..... 200/151

[58] Field of Search ..... 200/151

[56] References Cited

U.S. PATENT DOCUMENTS 4,458,225 7/1984 Forsell ..... 200/151

4,700,030 10/1987 Belbel et al. ..... 200/151

*Primary Examiner*—Robert S. Macon

*Attorney, Agent, or Firm*—M. J. Moran

[57] ABSTRACT

A current limiting circuit interrupter with insulating wedge characterized by a circuit interrupter structure within an insulating housing and having a mechanism for opening and closing separable contacts, the contacts being separately mounted on contact mounting arms that extend in substantially parallel spaced locations to effect current limiting relationship between the arms to cause any arc forming between the opening contacts to blow out of the contacts in a direction away from the spaced contact arms, a dielectric plate-like shutter in the plane extending between the contacts and in the direction opposite the contact arms, the shutter being movable into a gap formed between the separating contacts when the contacts separate, moving mechanism for moving the shutter when the contacts open and reset structure for retracting the shutter when the contacts close.

6 Claims, 6 Drawing Sheets

CURRENT LIMITING CIRCUIT INTERRUPTER WITH INSULATING WEDGE

BACKGROUND OF THE INVENTION

1. Field of the Invention

This invention relates to a current limiting circuit interrupter and particularly to such an interrupter having an insulating wedge.

2. Description of the Prior Art

Large short circuit currents result from the use of low impedance transformers and interconnected networks in modern low voltage a.c. power distribution systems. Today, fault currents in excess of 100 KA are common. Traditionally, high fault current protection has been provided by current limiting fuses in conjunction with circuit breakers. However in recent years a new generation of high speed electromagnetically driven, single and multiple break current limiting devices have been developed. These devices not only perform the functions of a circuit breaker and current limiting fuse, but are also resettable and reusable. These devices can also be effectively applied to motor control as well as power distribution systems.

A review of the patent and technical literature reveals a wide variety of current limiting design concepts. All schemes use the electromagnetic forces generated by the fault current to achieve rapid contact separation. Two major factors control how well current limiting occurs; namely, how quickly the contacts part after initiation of the fault current and how rapidly the impedance of the air-arc develops.

It is well known that effective current limiting requires rapid contact separation. The operation of the traditional circuit breaker was far too slow for current limiting. Over the years, two basic design schemes have been developed which meet this current limiting requirement. That is, a solenoid/kicker system and a repulsion design using two closely spaced contact arms. Both schemes use the electromagnetic forces generated by the fault current to achieve rapid contact separation. Of these two designs, the repulsion scheme is the most direct. In this design, the mass to be accelerated is minimized, thus attaining high contact separation velocities. A variety of current limiting design concepts utilizing electromagnetic repulsion are available in the patent and technical literature. Notwithstanding the foregoing considerations, a problem of rapid arc extinction remains.

SUMMARY OF THE INVENTION

It has been found in accordance with this invention that a current limiting interrupter with an insulating wedge may be provided which comprises a circuit breaker structure having first and second separable contacts operable between open and closed positions and forming a gap therebetween, means for opening and closing the contacts, the first and second contacts being mounted on first and second contact arms respectively which arms extend in substantially parallel spaced locations to effect current limiting relationship between the arms, at least one of the arms being pivotally mounted for movement, a plate-like shutter of electrically insulated material in the plane extending through the gap and movable into the gap when the contacts are separated, moving means for moving the plate-like shutter into the gap, the shutter including a first portion disposed in said plane on the side of the gap opposite the contact arms and movable therefrom and through the gap to a position between the contacts and at least partially disposed between the arms, whereby the formation of an arc between the contacts is minimized, the current limiting relationship between the arms causing an arc to move out of the gap in an axial direction opposite the arms, the shutter including a second portion extending between the arms, the shutter including a window aligned with the contacts and through which a contact extends during the closed contact position and the latch means retaining the window in alignment with the contacts and comprising an edge of the window in abutment with the movable contact, and reset means for retracting the shutter to a position of window alignment with the closed contacts.

The advantage of this device is that is greatly facilitates elimination of any arc occurring between the contacts during opening thereof.

DESCRIPTION OF THE PREFERRED EMBODIMENTS

Figure 1:
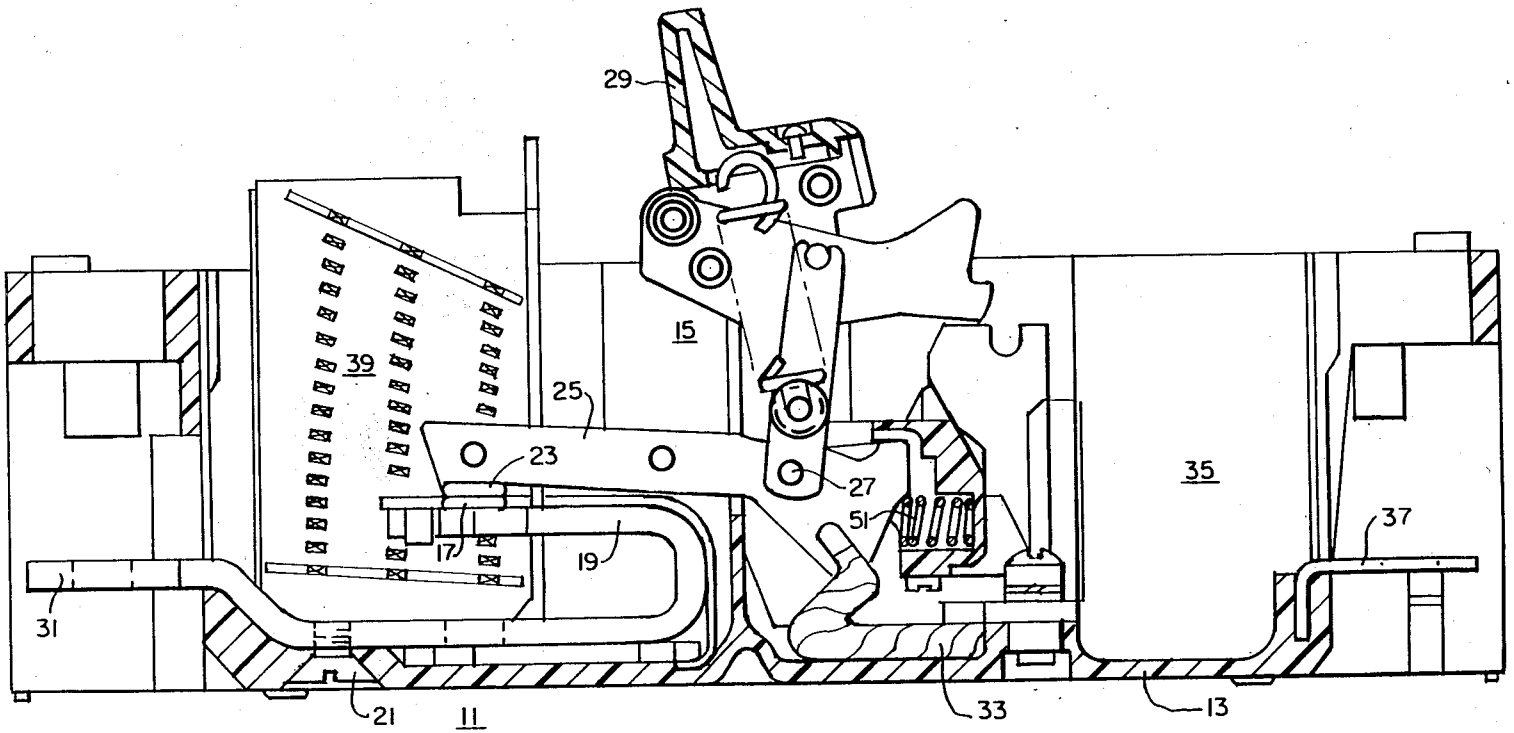
PRIOR ART FIG. 1.
FIG. 1 is a vertical sectional view through a circuit limiting circuit breaker of prior art construction.

In FIG. 1 a circuit breaker of prior art construction is generally indicated at 11 and it comprises an insulating housing 13 and a circuit breaker operating mechanism 15. The circuit breaker 11 is preferably a three-pole breaker comprising three compartments disposed in side-by-side relationship with the center pole compartment (FIG. 1) separated from two outer pole compartments by insulating barrier walls formed with the housing base and a housing cover (not closed). The operating mechanism 15 is disposed in the center pole compartment and is a single operating mechanism for operating the contacts of all three-pole units.

Each pole unit comprises a stationary contact 17 that is fixedly secured to a rigid main conductor for contact arm 19. That in turn is secured to the housing 13 by a bolt 21. In each pole unit, a movable contact 23 is secured, such as by welding or brazing, to a contact arm 25 that is mounted on a pivot pin 27. The arm 25 for all three of the pole units is supported at one end thereof and rigidly connected on a common insulating tie bar (not shown) by which the arms of all three pole units are moved in unison. Each of the contact arms 25 is biased about the associated pivot pin 27.

The operating mechanism 15 actuates the switch arms 25 between open and close positions and comprises a toggle mechanism of conventional construction.

The circuit breaker is manually operated to the open position by movement of a handle 29 in the clockwise direction. Conversely, the circuit breaker is manually closed by counterclockwise movement of the handle 29 from the "off" position to "on" position which movement is transmitted through the circuit breaker mechanism including the toggle links for all of the pole units when the contacts 17, 23 are closed (FIG. 1) a circuit through each pole extends from a left-hand terminal 31 through the conductor 19, contacts 17, 23, the contact arm 25, a flexible conductor 33, a conductor (not shown) within a trip device 35 to a terminal 37. The contacts 17, 23 are disposed within an arc extinguisher or arc chute 39.

Figure 2:
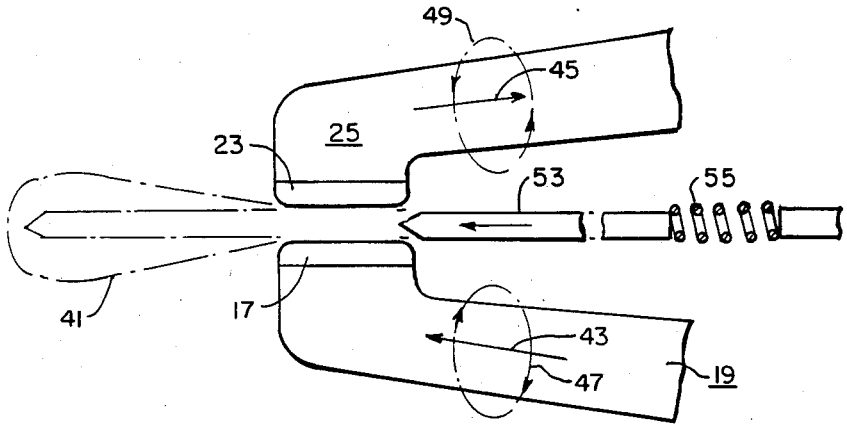
PRIOR ART FIG. 2.
FIG. 2 is a schematic view of a pair of contact carrying arms showing an arc extinguishing wedge of prior art construction.

As shown in FIG. 2, when the contacts 17, 23 open, an electric arc 41 is projected or "blown" to the left. This occurs whether the contacts are open manually by the handle 29 or by the trip device 35 when an overcurrent passes through the device in a manner well-known in the art. Prior to opening of the contacts a current passes through the arm 19 in the direction of the arrow 43 and through the arm 25 in the opposite direction as shown by the arrow 45. Under normal closed contact condition, the contact arm 25 is disposed in the position shown in FIG. 1. As a current flows through the arm in the direction of the arrows 43, 45, electromagnetic repulsion forces 47, 49 are generated in opposite directions between the arms which tend to open the contact 17, 23. At rate current, contact forces holding the contact arms 19, 25 together are greater than the combined effect of the repulsion forces 47, 49. A threshold level exists where the repulsion forces are equal to the combined forces acting on the arm including a spring 51 (FIG. 1) and a circuit breaker mechanism 15 hold the contacts together.

When subjected to a high short circuit current, contacts 17, 23 are driven apart rapidly and the arc 41 is generated between the contacts. In the design of the circuit breaker (such as disclosed in FIG. 1) two major factors control how well the current limiting action between the parallel contact arms 19, 25 occur; namely, how quickly the contacts separate after the initiation of a fault current and how rapidly the impedance of the arm develops. To develop a high arc voltage and minimize contact erosion, the arc must be stretched and driven off the separating contacts quickly. Since the repulsion forces separating the contacts are related to the current squared ($I^2$), the larger the fault current, the faster the contacts open. Thus, the current limiting action is effective over a wide range of fault currents.

In order to extinguish the arc 41 more rapidly an insulating plate or wedge 53 has been provided in prior art devices for the purpose of extending through the separating contacts 17, 23 as soon as the arc develops. When the contacts 17, 23 are closed, the left end of the plate 53 abutted the right end surfaces of the closed contacts under the force of a coil spring 55. Thus, upon separation of the contacts the plate 53 was free to move rapidly under the pressure of the spring 55 into and through the arc 51 thereby extinguishing the arc. However, inasmuch as the plate 53 moves much slower, such as in milliseconds, as compared to the speed of movement of the arc 41, such as in microseconds, the plate 53 does not current limit the circuit as effectively as had been anticipated.

Figure 3:
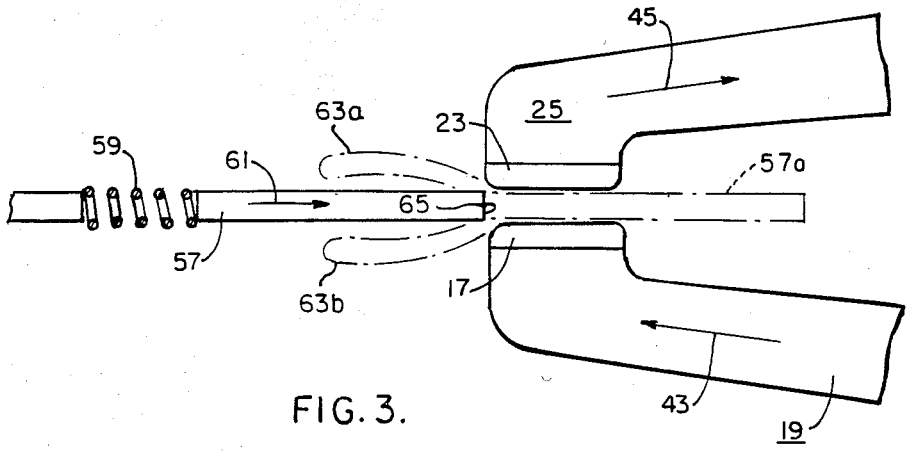
FIG. 3 is a schematic view of the device in accordance with this invention.

In accordance with this invention, the device shown in FIG. 3 is proposed to current limit the circuit more effectively. A plate or wedge 57 is biased by a spring 59 in the direction of the arrow 61 into the gap between the opening contacts 17, 23. When the contacts are closed, the right end of the wedge 57 is disposed against the left surfaces of the closed contact 17, 23. As soon as the contacts separate, either manually or by an electronic trip device or short circuit, an arc 63 is generated and blown to the left against the confronting edge of the wedge 57, whereby two portions **63*a*, 63*b* of the arc are disposed above and below the wedge. As the wedge 57 is impelled to the right as indicated by the arrow 61, the arc portion 63*a*, 63*b* are extended to even greater lengths, whereby the arc 63 is extinguished more rapidly than in the device shown in FIG. 2**.

Figure 4:
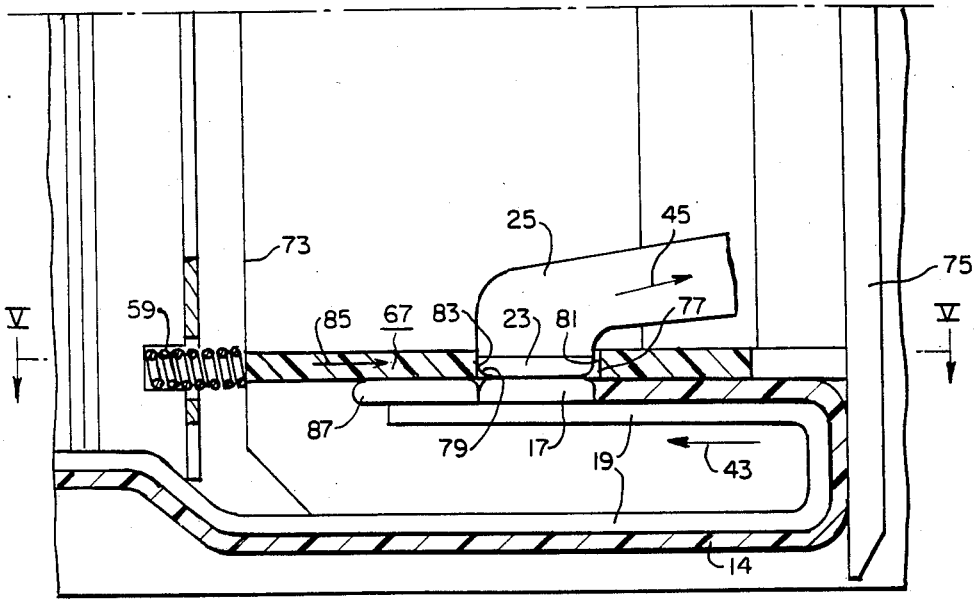
FIG. 4 is a sectional view through the contact and contact arm zone of a current limiting circuit breaker showing an arc extinguishing wedge in accordance with this invention.
Figure 5:
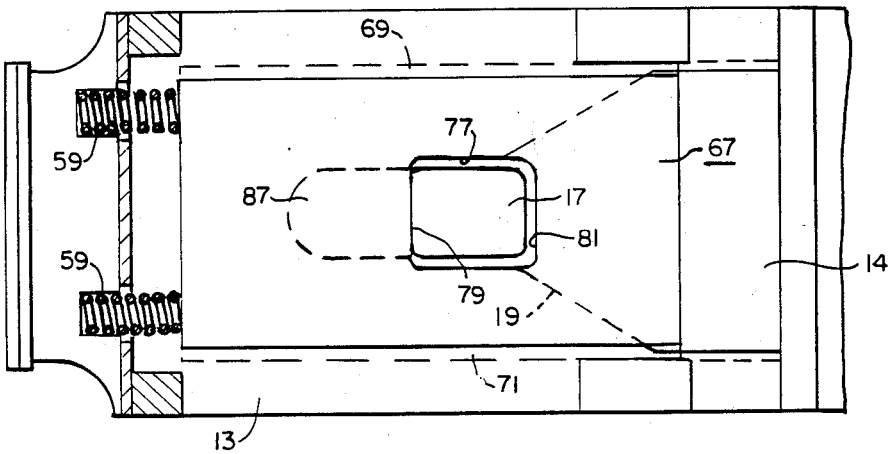
FIG. 5 is a horizontal sectional view taken on the line V—V, FIG. 4.

In other words the wedge 57 is disposed in the region into which the arc is moving or is blown into; rather, than being blown in a direction following the arc 41 as shown in FIG. 2. Manifestly, as the wedge 57 moves to the broken line position **57*a* (FIG. 3) the arc 63 is extended to an even greater length, whereby it is rapidly extinguished. In FIGS. 4 and 5 a structural embodiment of the device shown schematically in FIG. 3 is disclosed. For simplicity similar numerals refer to similar parts as shown in FIG. 1, except for certain additional parts as set forth hereinafter. In FIG. 4 a wedge 67 is disposed in a horizontal zone between the contact arms 19, 25. Coil springs 59 drive the wedge 67 to the right when the closed contacts 17, 23 are open from their closed position as shown. The wedge 67 is a rectangular body having opposite edges disposed in corresponding support slots 69, 71 within the housing 13. Thus the wedge is slidable between opposite walls 73, 75 in response to the springs 59**.

The wedge 67 includes an opening or window 77 which is substantially rectangular and has opposite edges 79, 81. In the closed position (FIG. 4) the contact 23 extends through the opening 77 with the edge 79 of the opening 77 abutting the surface of the contact 23 at 83. In this position the edge 81 of the opening 77 is spaced from the opposite wall of the contact 23.

So long as the contacts 17, 23 are closed, as shown in FIG. 4, the springs 59 are contracted, ready for driving the wedge 67 to the right in the direction of the spring 85 when the contact 23 is lifted. In this manner the opening 77 moves out of alignment with the lower contact 17 which is then covered by the body of the wedge 67 as it moves to the right, as viewed in FIG. 4, thereby terminating any arc occurring between the contacts 17, 23 when the contact 23 is raised. Support member 87 (mounted on the arm 19) is located adjacent to the lower contact 17 for supporting and guiding the portion of the wedge 67 as it moves over the contact 17 when the upper contact is raised.

When it is necessary to reclose the contacts the insulating wedge 67 must be retracted to the position shown in FIG. 4. For that purpose a resetting device is provided which comprises a reset lever 89, a pawl 91, a coil spring 93 and a pin 95. As shown in the schematic views of FIGS. 6, 7, 8 the lower end of the handle 29 is pivoted at 97 which is above a pivot point 99 of the lever 89. The pivot points 97, 99 are secured in portions of the housing 13. The pawl 91 is pivotally mounted at 101 on the upper end of the reset lever 89. A stop pin 103 limits counterclockwise rotation of the pawl by the spring 93, one end of which is secured to the pawl at 105 and the other end of which is secured to a portion of the housing 13 at 107. A stop 109 on the housing limits clockwise rotation of the lever 89 by the spring 93.

Figure 6:
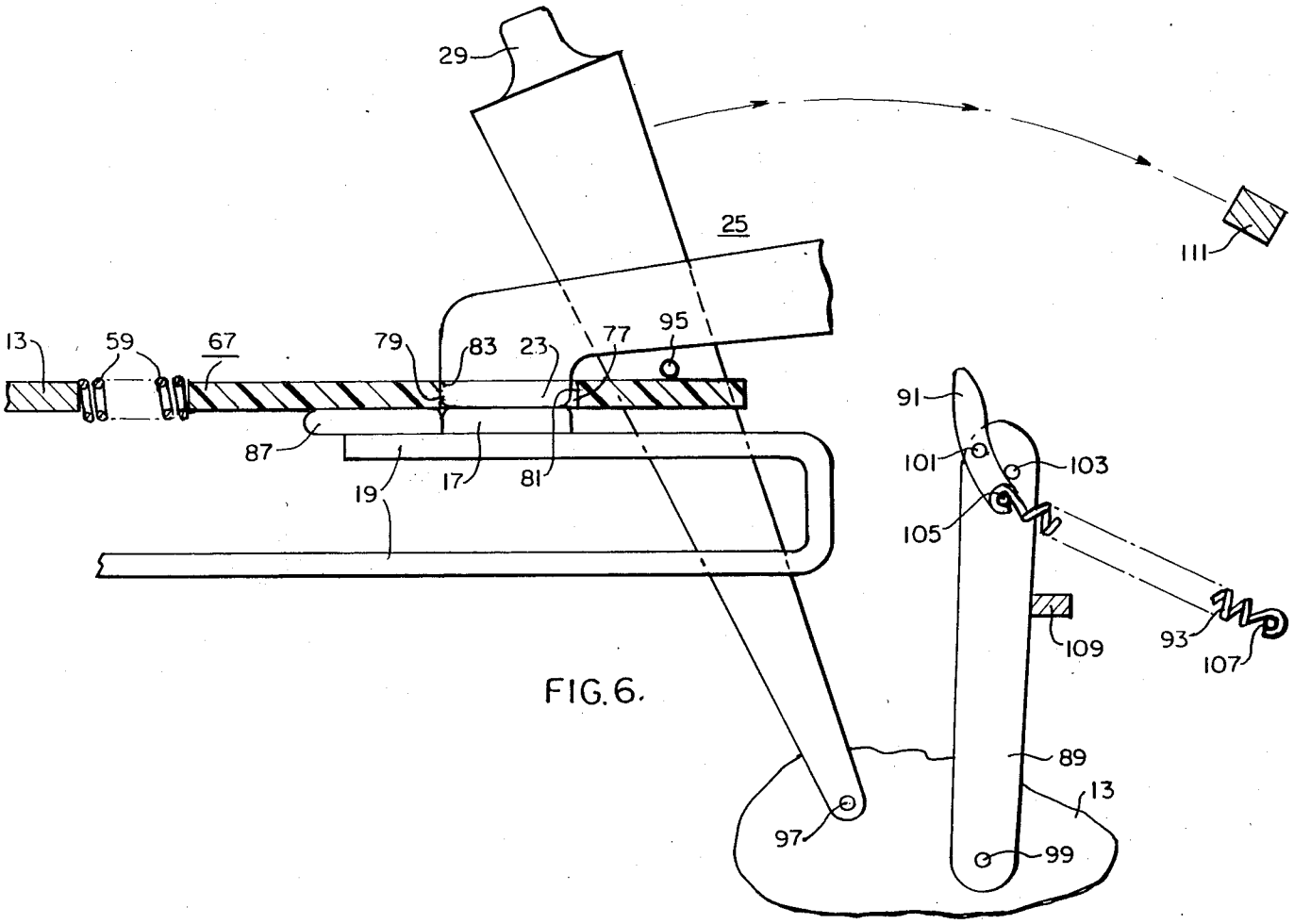
FIGS. 6, 7, and 8 are views showing the sequence of operation of the arc extinguishing wedge with which relation to the contact positions and the wedge resetting device.

As shown in FIG. 6 when the contacts 17, 23 are in the closed position the handle 29 is in the "on" position and the reset lever 89 is disposed against the stop 109.

Figure 7:
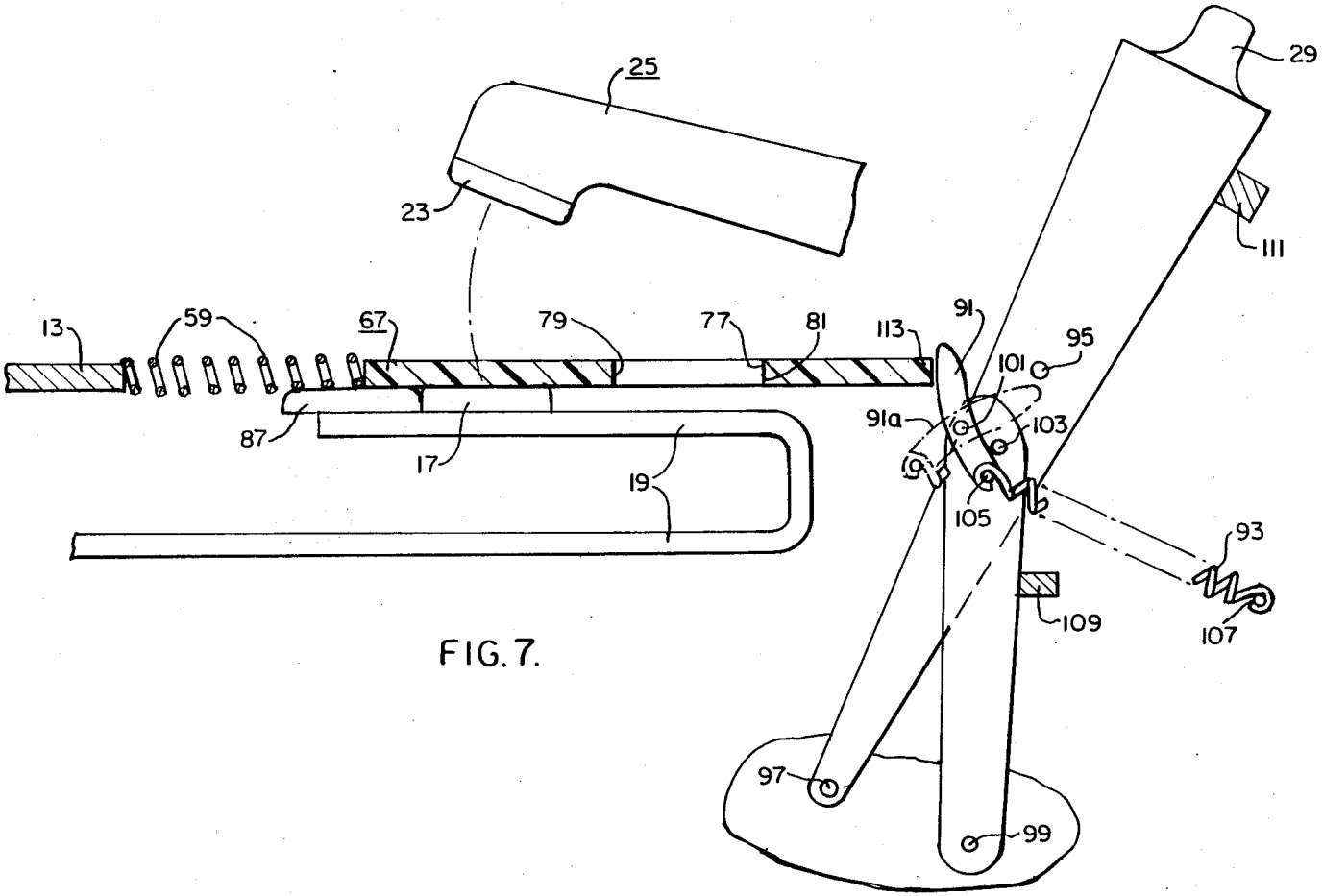

As shown in FIG. 7 when the contacts are open the wedge 67 is disposed on the lower contact 17 with the opening 77 disposed to the; right of the contact 17 and the handle 29 is in the "off" position against a stop 111 which may be part of that housing 13. As the handle 29 moves clockwise from the "on" position (FIG. 6) to the "off" position (FIG. 7) the pin 95 strikes the left side of the pawl 91 and rotates it clockwise to the broken line position 91*a* until the pin 95 passes over the upper end of the pawl, whereupon the spring 93 returns the pawl to the solid line position where the pawl is either in abutment with the right end 113 of the wedge 67, or slightly spaced therefrom.

When the handle 29 is moved toward the "on" position, the pin 95 moves against the pawl 91 which in turn moves against the right end 113 of the wedge 67 causing the opening 77 of the wedge to approach the position of alignment with the contact 17. As the handle 29 moves counterclockwise toward the "on" position of FIG. 6 it reaches a position where two incidents occur; namely, the opening 77 is in alignment with the contact 17 and the circuit breaker mechanism 15 passes through toggle, causing the contact arm 25 to lower and thereby close the contacts 17, 23. Just prior to that action the upper end of the pawl 91 moves the wedge 67 to a location (FIG. 8) where the edge 79 of the opening 77 is slightly to the left of the edge of the contact 23 so that there is clearance space between the contact 23 and opposite edges 79, 81 of the opening 77.

Figure 8:
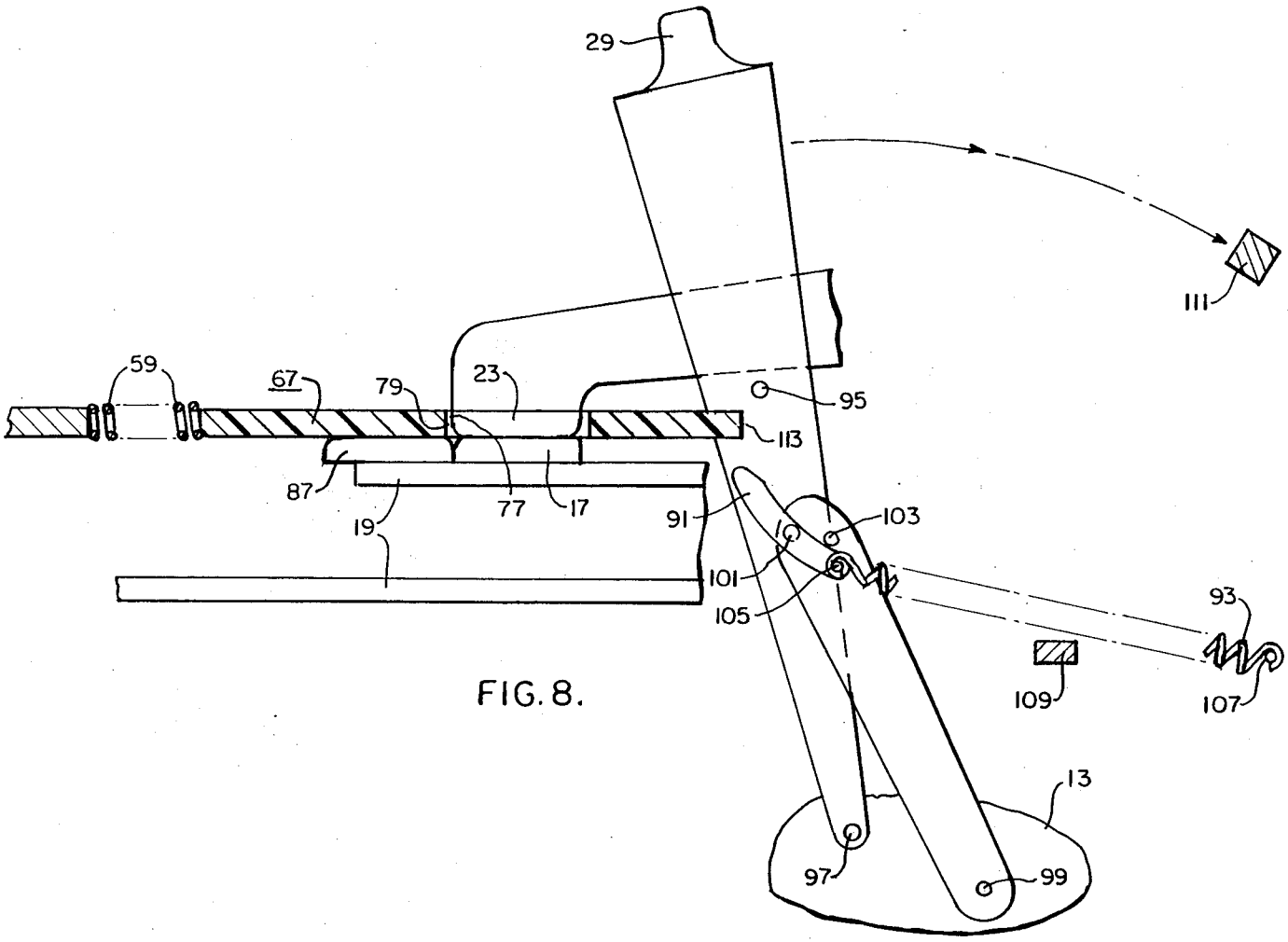

As the handle 29 continues to move counterclockwise from the position shown in FIG. 8 to the "on" position of FIG. 6, the upper end of the pawl 91 rotates out of contact with the pin 95 on the handle, and the coil spring 93 again rotates the assembly of the pawl and lever 89 clockwise to the position against the stop 109 (FIG. 6).

Thereafter when the contacts are opened either manually or by the trip device 35, the sequence of operations resumes as indicated above.

In conclusion the device of this invention provides is an expedient structure for extinguishing an electric arc between opening contacts more rapidly than has been possible in prior art structures. At the same time a means for resetting the arc extinguishing wedge is provided.

We claim:

1. A current limiting circuit interrupter with insulating wedge, comprising:

a circuit breaker structure having first and second separable contacts operable between open and closed positions and forming a gap therebetween, means for opening and closing the contacts, the first and second contacts being mounted on first and second contact arms respectively which arms extend in substantially parallel spaced locations to effect current limiting relationship between the arms, at least one of the arms being pivotally mounted for movement, a plate-like shutter of electrically insulating material in a plane extending through the gap and movable into the gap when the contacts are separated, moving means for moving the plate-like shutter into the gap, the plate-like shutter including a first portion disposed in said plane on the side of the gap opposite the contact arms and movable therefrom and through the gap to a position between the contacts and at least partially disposed between the arms whereby the formation of an arc between the contacts is minimized, and the shutter having a leading edge in latched abutment with the movable contact for release into the gap of the movable contact.

2. The circuit interrupter of claim 1 in which the moving means comprises a spring.

3. The circuit interrupter of claim 2 in which the current limiting relationship between the arms causes an arc to move out of the gap in an axial direction opposite the arms and toward the leading edge of the shutter.

4. The circuit interrupter of claim 3 in which the plate-like shutter includes a second portion extending between the arms.

5. The circuit interrupter of claim 4 in which the plate-like shutter includes a window aligned with the contacts and through which a contact extends during the closed contact position, and latch means fox retaining the window in alignment with the contacts and comprising an edge of the window in abutment with the movable contact.

6. The circuit interrupter of claim 5 in which there are reset means for retracting the shutter to a position of window-alignment with the closed contacts.

* * * * *